United States Patent [19]

Riley et al.

[11] Patent Number: 4,658,554

[45] Date of Patent: Apr. 21, 1987

[54] PROTECTED MEMBRANE ROOF SYSTEM FOR HIGH TRAFFIC ROOF AREAS

[75] Inventors: Elizabeth Riley, Newark; Wayne E. Petersen, Granville, both of Ohio

[73] Assignee: The Dow Chemical Company, Midland, Mich.

[21] Appl. No.: 686,069

[22] Filed: Dec. 24, 1984

[51] Int. Cl.[4] ..... E04C 2/02; E04C 2/32; E04B 7/00

[52] U.S. Cl. ..... 52/309.8; 52/408

[58] Field of Search ..... 52/408, 410, 199, 309.5; 156/324.4

[56] References Cited

U.S. PATENT DOCUMENTS

| | | | |
|---|---|---|---|
| 3,318,744 | 5/1967 | Hurley | 156/322 |
| 3,892,899 | 7/1975 | Klein | 52/408 X |
| 4,370,374 | 1/1983 | Raabe et al. | 156/324.4 |
| 4,464,215 | 8/1984 | Cogliano | 52/169.14 |
| 4,492,064 | 1/1985 | Bynoe | 52/309.8 |

FOREIGN PATENT DOCUMENTS

| | | | |
|---|---|---|---|
| 1816577 | 6/1970 | Fed. Rep. of Germany | 52/199 |
| 2327840 | 12/1974 | Fed. Rep. of Germany | 52/408 |
| 2734195 | 2/1979 | Fed. Rep. of Germany | 52/199 |
| 2742444 | 3/1979 | Fed. Rep. of Germany | 52/408 |
| 135639 | 5/1979 | German Democratic Rep. | 52/408 |
| 775258 | 10/1980 | U.S.S.R. | 52/199 |

*Primary Examiner*—Leslie Braun
*Assistant Examiner*—John Malcolm White
*Attorney, Agent, or Firm*—L. E. Hessenaur, Jr.

[57] ABSTRACT

An insulated roofing system is provided in which a waterproof membrane is applied to the roof deck. Extruded panels of closed cell polystyrene foam are provided on top of the membrane, thus protecting the membrane from thermal cycling, ultraviolet rays, and physical damage. The foam panels provide excellent insulation and are resistant to water. A waterproof plastic film is bonded to the under surface of each panel positively to exclude water. The foam panels are extruded and are provided on the upper surface with integral ribs spaced by grooves. Concrete panels are laid directly on top of the polystyrene foam and lie gravitationally on the ribs. The ribs provided for ventilation and moisture removal on hot, dry days.

4 Claims, 3 Drawing Figures

PROTECTED MEMBRANE ROOF SYSTEM FOR HIGH TRAFFIC ROOF AREAS

BACKGROUND OF THE INVENTION

For many years it was the universal practice to construct roofs with a waterproof layer or membrane on the outer surface thereof. Such roofing is still used in many installations, but has many disadvantages. The waterproof membrane, which may be bituminous built-up sheet or which may be a single sheet of waterproof material, is exposed to extreme temperature variations, as much as 210 degrees F., to ultraviolet radiation, and to physical abrasion, all of which have a deleterous effect on the life of the roofing.

It has been common practice for a great many years to provide insulation in roof construction, and when insulation is provided below the waterproof membrane, in the roofing system outlined above, it is often necessary to provide a second waterproof membrane below the insulation to prevent moisture from within the building from condensing in the insulation and inhibiting or destroying its insulating qualities.

An alternative upside-down roofing construction is known in which the insulation is applied over the waterproof membrane, see for example U.S. Pat. Nos. 3,411,256 and 3,763,614. In this alternative roof construction the waterproof membrane, which may be a built-up membrane or a single waterproof layer such as of elastomeric, plastomeric, liquid applied or modified bitumen is applied directly to the surface of the roof. Blocks of foam plastic insulation are then applied over the waterproof membrane. Polystyrene plastic resin foam is a superior product for such use, and STYROFOAM brand plastic foam made by Dow Chemical Company is a preferred example. It is a tough, closed cell rigid plastic foam having excellent moisture resistance and high compressive strength.

The polystyrene foam insulation placed over the waterproofing membrane rather than under the membrane protects the membrane from the effects of thermal cycling, temperature extremes, and physical abuse, thus reducing maintenance costs and prolonging the life of the entire roofing system. It has been found that the membrane so protected remains at stable temperatures below 100 degrees F. even in hot summer weather. In fact, under normal conditions, the temperature of the membrane will remain within 15–20 degrees F. of the building's inside temperature.

Typically, a polymeric fabric is installed over the foam to stablize the system, and crushed stone or gravel ballast is applied to counteract the buoyancy of the insulation boards, to provide flammability resistance to the roof surface, and to shield the foam and fabric from ultraviolet radiation. As an alternative, paving blocks may be used in place of stone, particularly if traffic is to be expected on the roof.

When traffic is expected, as in the construction of a plaza deck, pedestals or stone are provided to space the paving blocks above the top of the foam insulation to permit adequate air circulation for drying of the roofing system on warm, dry days. It will be appreciated that a base roof or deck of substantial strength must be provided to support the weight of such a roofing system.

OBJECTS AND SUMMARY OF THE PRESENT INVENTION

It is an object of the present invention to provide a roofing system in which a waterproof membrane is applied directly to the surface of a roof, suitable panels of rigid foam insulation having a plastic film laminated to the lower surface are applied over the membrane, and concrete paving blocks are applied directly to the foam insulation without the necessity of pedestals or stone.

More particularly, it is an object of the present invention to provide such a roofing system in which the upper surfaces of the foam plastic insulating blocks are ribbed, having alternating ribs and valleys, with the concrete paving blocks laid directly on the ribbed surfaces of the foam blocks.

Extruded panels of polystyrene foam insulation are now available having one surface with integrally formed, alternating ribs and grooves of equal width. We have found somewhat surprisingly, that the polystyrene foam plastic material in the ribs is stiffer, stronger, and more resistant to deformation than the foam plastic material in the valleys, and throughout the panels. It is believed that this is due to molecular orientation of the material brought about as it foams during extrusion. In accordance with the present invention such foam plastic insulation material having a plastic film laminated to the lower surface is used on top of a waterproof membrane, and concrete paving blocks are laid directly on the ribs of such material and are held gravitationally thereon.

THE DRAWINGS

The invention will best be understood from the following specification taken in connection with the accompanying drawings wherein.

DETAILED DESCRIPTION OF THE ILLUSTRATED EMBODIMENT

Figure 1:
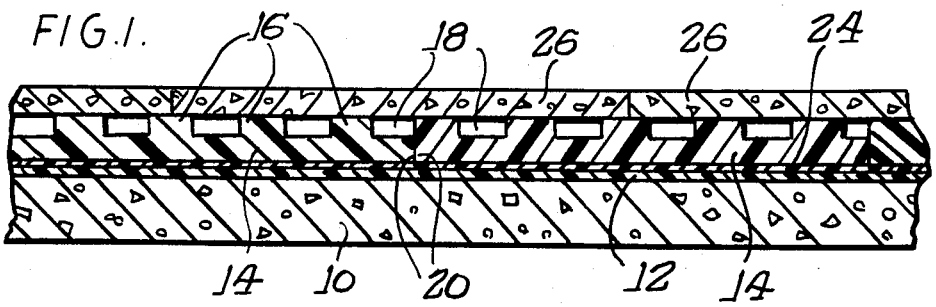
FIG. 1 is a fragmentary cross-sectional view through a roofing system constructed in accordance with the principles of the present invention.
Figure 2:
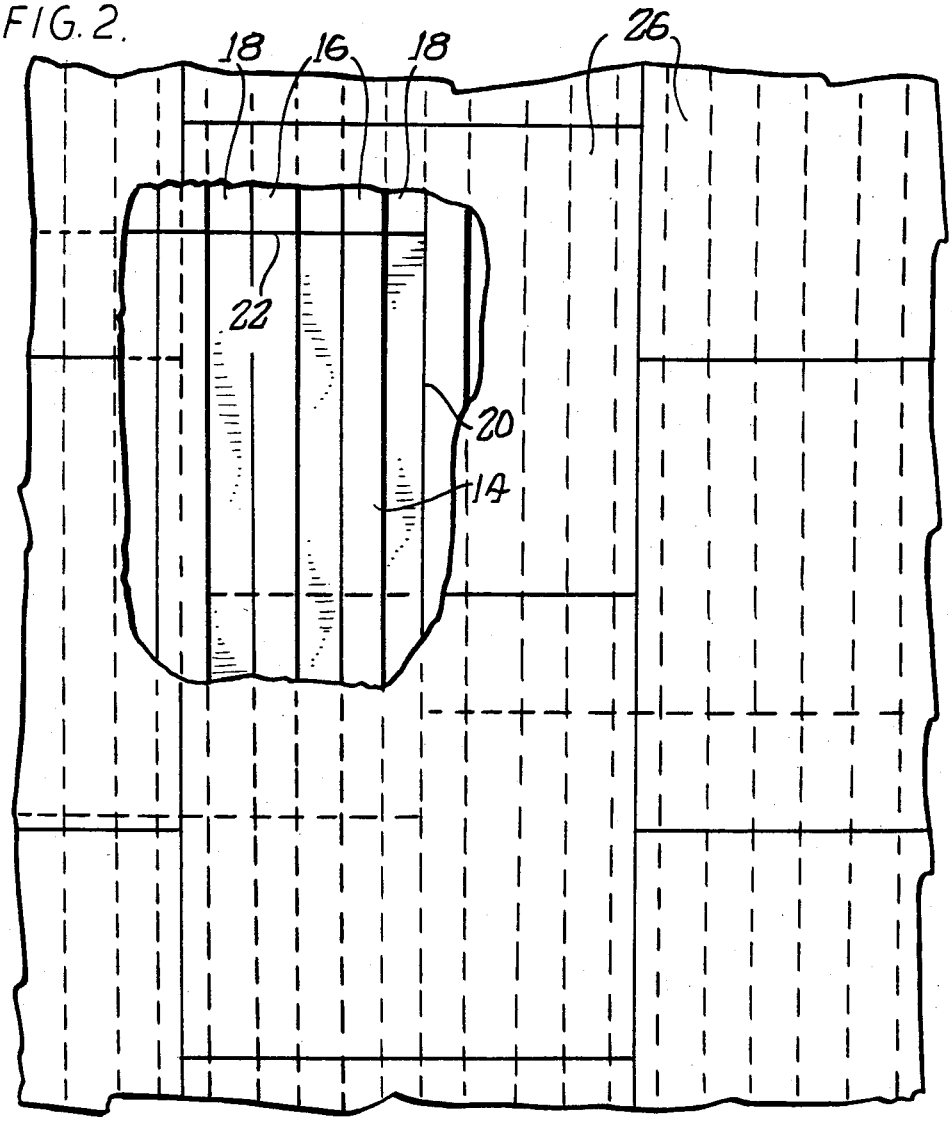
FIG. 2 is a top view thereof with a portion broken away.

A base roof or deck 10 is shown in FIG. 1 as comprising a concrete slab. This slab would preferably be reinforced. The roof deck could equally well be of wood construction, or of metal construction, and concrete simply has been chosen by way of illustration. A waterproof membrane 12 overlies the roof deck 10. The membrane can be attached to the roof deck, or it can be loose. The membrane can be a single sheet of polymeric material, liquid applied, modified bituminous sheet, or it can be an asphaltic built-up membrane.

Panels 14 of extruded polystyrene foam are laid on top of the membrane 12. The foam panels include on the top surface only integrally extruded ribs 16 interspaced by grooves or valleys 18. The ribs and the grooves are of equal lateral extent, being approximately one inch wide, and about ⅛ to one-half inch deep. We have observed that the foam material of the ribs is stronger, more rigid, and more deformation resistant than the material of the grooves or valleys, and this is thought to be due to cellular orientation produced by foaming of the plastic material during extrusion. The polystyrene foam panels are butted together along the longitudinal edges 20 thereof. The ends 22 of the panels also are butted together. The thickness of the foam panels depends on the degree of insulating quantity desired, but typically would be on the order of one to six inches thick. The extruded polystyrene foam is of the closed cell variety for moisture resistance. The foam panels by way of illustration are two feet by four feet, but the dimensions are not critical. The lengths could easily be nine feet, or as much as sixteen feet, while the width could be as little as sixteen inches, to perhaps as much as four feet. Product size is not a critical factor, but handleability is. In windy areas the panels must not be so large as to be blown from a roof before the paving blocks are applied to hold them down.

A plastic film lamination 24 is secured to the lower surface of each foam insulation panel. The film may be adhesively secured to the foam, or may be heat bonded thereto. In one preferred example of the invention the film 24 comprises LLDPE (low linear density polyethylene) (1.7 mils.) plus EVA (ethylene-vinyl acetate) (0.3 mils). Upon heating the EVA softens easily and adheres the film tenaciously to the foam. There may also be a certain softening of the foam which enhances the adherence.

Concrete paving blocks 26 are laid directly on top of the foam panels 14. The paving blocks conveniently are two feet square and two inches thick, and are not necessarily reinforced. Other dimensions can be used, such as eight inches by sixteen inches, and reinforcement of the concrete can be used if desired. The concrete blocks are simply butted against one another, and preferably are laid so that the butted junctions do not coincide with the butted junctions of the underlying foam panels.

Figure 3:
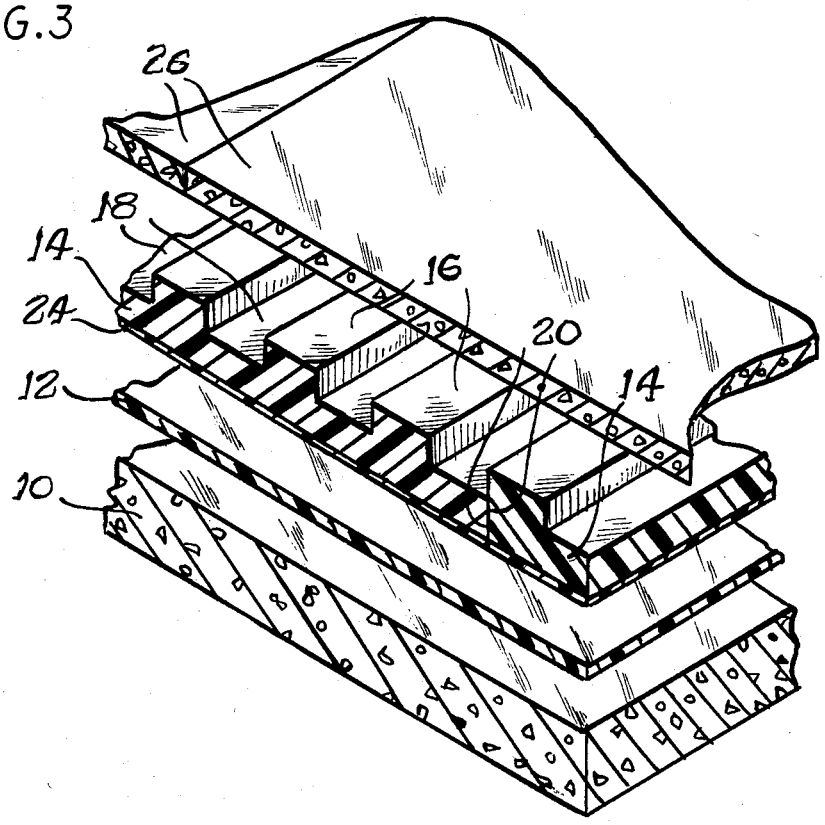
FIG. 3 is a fragmentary exploded perspective view showing the relation of parts of the roofing system to one another.

The fragmentary exploded perspective view of FIG. 3 is similar to FIG. 1 and emphasizes the adherence of the film 24 to the underside of a panel 14 and the nonsecurement of other parts to one another.

The polystyrene foam panels are of the closed cell variety and are reasonably waterproof. However, constant presence of water will cause some water penetration and loss of insulating qualities. The film adhered or sealed to the bottom surface of the foam panels inhibits water penetration of the foam. The alternating ribs and recesses or valleys in the upper surface of the foam permit air circulation so that any rainwater or other moisture on top of the panels is dissipated on hot, dry days. As will be appreciated, sun shining on the concrete paving blocks will heat the air in the recesses and between the ribbed surfaces and the concrete paving blocks, thereby materially increasing the pressure of such air, thus augmenting the convection forces causing air to exit through the butted joints of the concrete paving blocks. Moisture penetration of the foam panel, and resulting loss of insulating qualities therefore is substantially reduced by the present invention. Accumulation over time is also minimal. A film of water such as might lie between a flat topped foam insulation panel and a paver laid directly thereon would act as a vapor barrier to prevent drying out of the foam. With the present construction any film that might lie between the tops of the ribs and the concrete paving blocks is of minimal importance, since the sides of the ribs and the floors of the grooves or valleys provide a large area free of such film for drying of the foam. Furthermore, some heating of the paving blocks dissipates the film as water vapor into the grooves or valleys between the ribs, from whence it circulates out through the butt joints between the paving blocks. The ribbed construction also facilitates drying of the undersurfaces of the paving blocks. Constant wetness of the undersurfaces of the paving blocks causes the bottom surfaces thereof to spall off in a few years.

In conventional plaza construction using upside-down roof construction, pedestals are used for supporting the weight of the concrete paving blocks. Pedestals occupy space that could otherwise be used for insulation, and hence do not add to the overall insulating qualities. In addition, the pedestals are expensive, both in material cost and in labor of installation. In accordance with the present invention the costs of pedestals and the non-insulating area thereof are eliminated. The present construction is not intended as a full substitute for plaza construction, but it can support rather considerable weight, and is fully suitable for foot traffic or for small vehicles for maintenance. STYROFOAM insulation, for example, has a design compressive strength of about 25 pounds per square inch. If a safety factor of 5:1 is provided, then this reduces to 5 pounds per square inch. A 24 by 24 inch paving block has approximately 600 square inches, which covers a like area of the present plastic foam insulation, but divided by two due to the equal widths of the ribs and valleys. This provides 300 square inches of supporting area for a two foot by two foot paving block, which multipled by the five pounds per square inch previously noted results in a total of 1500 pounds that can be applied to each paving block with a 5:1 safety factor against permanent deformation of the supporting STYROFOAM insulation due to creep and compressive fatigue. Probably an even greater total weight can be supported, since, as previously noted, the foam plastic material in the ribs is stiffer, stronger, and more resistant to deformation than the foam plastic material in the valleys. Other foam plastic insulating materials have a compressive strength as low as 10 pounds per square inch, but with the 5:1 safety factor heretofore used as exemplary, each paving block can support 600 pounds with such foam plastic material.

Exemplary dimensions have heretofore been given for the rib width and spacing. However, these dimensions can vary widely. The ribs might be as little as 1/16th inch high, and the supporting area could be less than 50%, i.e., the ribs could be narrower than the intervening valleys.

The present roofing system is highly desirable for construction of insulated roofs in which a certain amount of traffic or maintenance is anticipated. The present roof construction also is beneficial for use in roof construction below radio and TV antenna towers in cold climates. Icicles dropped from such towers readily penetrate gravel topped roof constructions, initially damaging the membrane, and/or underlying insulation and leaving them vulnerable to possible further deterioration from water and ice. The paving blocks used in the present construction are not penetrated by such icicles, whereby no damage is caused by falling icicles.

A figure of 25 pounds per square foot compressive strength for polystyrene insulation has been given heretofore. This is a minimum figure, and the compressive strength typically will run on the order of 40 pounds per square inch. Such forces result in approximately 1/10th inch deformation, and dimensions return to normal upon removal of the compressive force if has not been reached.

The present roof system posesses the advantage of prior upside-down insulated roof construction. However, in addition thereto water absorption by the insulation is markedly reduced by the film bonded to the lower surface of the insulation, and by the ribbed upper surface which allows drying of the insulation and the underside of the paving blocks on warm, dry days. When the waterproofing membrane applied to the top of the roof deck is a bituminous built-up laminated structure or the membrane is necessarily secured to the deck. However, in instances where a polymeric sheet is used, it can be applied loose over the surface of the deck, and the entire structure is held down by the weight of the concrete paving blocks.

The specific example of the invention as herein shown and described is for illustrative purposes only. Various changes in structure will no doubt occur to those skilled in the art, and will be understood as forming a part of the present invention insofar as they fall within the spirit and scope of the appended claims.

The invention is claimed as follows:

1. A roofing system comprising a roof deck, a waterproof membrane above said roof deck, a plurality of extruded panels of foam plastic insulation above said waterproof membrane, each of said foam plastic insulation panels having peripheral edge surfaces and having a planar lower surface and having a plurality of flat topped integrally extruded parallel raised elongated ribs on the upper surface thereof and spaced apart by grooves, said ribs being stiffer, stronger, and more resistant to deformation than the remainder of each panel, the tops of said ribs forming a discontinuous planar surface substantially parallel to said lower surface, a waterproof plastic film having peripheral edges coincident with the peripheral edge surfaces of a respective panel and being coextensive with and bonded to only the lower surface thereof and resting on said waterproof membrane in an unsecured face-to-face contacting relation, each of said panels being otherwise free of plastic film and exposed to ambient air for evaporation of moisture, said plurality of panels having said peripheral edge portions and said film peripheral edges in substantially abutting relation, and a plurality of concrete panels overlying said foam plastic insulation panels and resting on said rib top discontinuous planar surface.

2. A roofing system as set forth in claim 1 wherein said film is heat bonded to said panel lower surface.

3. A roofing system as set forth in claim 2 wherein said film is a composite film having a portion heat softened to fuse said film to said foam panels.

4. A roofing system as set forth in claim 3 wherein said film comprises low density polyethylene and ethylene-vinyl acetate.

* * * * *